US006289519B1

(12) United States Patent
Murakami et al.

(10) Patent No.: US 6,289,519 B1
(45) Date of Patent: Sep. 18, 2001

(54) THROWAWAY TRUNKS TYPE UNDERPANTS

(75) Inventors: Masaki Murakami; Michiyo Matsushita; Akira Myoga; Hitomi Ishikawa, all of Kagawa (JP)

(73) Assignee: Uni-Charm Co., LTD (JP)

( * ) Notice: Subject to any disclaimer, the term of this patent is extended or adjusted under 35 U.S.C. 154(b) by 0 days.

(21) Appl. No.: 09/601,969

(22) PCT Filed: Dec. 9, 1999

(86) PCT No.: PCT/JP99/06922

§ 371 Date: Oct. 16, 2000

§ 102(e) Date: Oct. 16, 2000

(87) PCT Pub. No.: WO00/33680

PCT Pub. Date: Jun. 15, 2000

(30) Foreign Application Priority Data

Dec. 9, 1998 (JP) ..... 10-350415

(51) Int. Cl.[7] ..... A41B 11/00

(52) U.S. Cl. ..... 2/400; 2/403; 2/406; 604/385.1; 604/378

(58) Field of Search ..... 2/79.83, 228, 238, 2/114, 400–409, 78.1, 78.2, 69; 604/385.1, 385.2, 386–398

(56) References Cited

U.S. PATENT DOCUMENTS 4,205,679 * 6/1980 Repke et al. ..... 604/385.1
4,630,320 * 12/1986 Van Gompel ..... 2/402
4,698,855 * 10/1987 Hicks ..... 2/402
4,745,636 * 5/1988 Lunt ..... 2/402
4,883,481 * 11/1989 Blanchard ..... 604/385.1
5,340,424 * 8/1994 Matsushita ..... 2/401 X
5,440,764 * 8/1995 Matsushita ..... 2/401
5,864,890 * 2/1999 Niedermeyer ..... 2/403
6,092,242 * 7/2000 Niedermeyer ..... 2/400
6,240,563 * 6/2001 Niedermeyer ..... 2/114

FOREIGN PATENT DOCUMENTS

S42-9056 5/1967 (JP) .
H4-60501 5/1992 (JP) .

* cited by examiner

*Primary Examiner*—Gloria M. Hale
(74) *Attorney, Agent, or Firm*—Baker & Daniels

(57) ABSTRACT

Pants that comprise a pair of intermediate body sheets, positioned in plane symmetry to each other and respectively contoured by upper, lower, inner and outer edges, and a pair of lateral body sheets also positioned outside the respective intermediate body sheets and respectively contoured also by upper, lower, inner and outer edges. Each of the intermediate body sheets is formed between the inner and outer edges with an arcuate cutout extending convexly from the upper edge, toward the lower edge the intermediate body sheets being put flat and sealed together along a sealing line defined by the cutouts but leaving a narrow marginal edge free. The intermediate body sheets and the lateral body sheets are placed flat and sealed together along sealing lines defined by inner and outer edges thereof, leaving narrow marginal regions free outside the inner and outer edges.

6 Claims, 5 Drawing Sheets

THROWAWAY TRUNKS TYPE UNDERPANTS

FIELD OF THE INVENTION

This invention relates to disposable trunks-type pants.

BACKGROUND ART

Trunks- or briefs-type pants are usually made by cutting the stock material in components such as front and rear bodies and then stitching these components together. The pants completely stitched up must be subjected to finishing the steps of pressing or heat-setting and verification before the finished goods.

Such pants are based on the assumption that the pants will be repeatedly used. However, there has been an increased demand for disposable pants adapted to be worn not only by medical teams such as physicians and nurses but also by patients. On the other hand, a good feeling to wear is also required for such pants. However, the trunks-type pants are generally characterized in that the cuffs are not in close contact with wearer's thighs and therefore these cuffs are apt to be turned up along the wearer's thighs inside out during actual use of the pants. Such tendency of the cuffs to be turned up inside up may adversely affect the feeling to wear the pants.

SUMMARY OF THE INVENTION

It is an object of this invention to provide disposable trunks-type pants in which the cuffs are not readily turned up inside out.

The object set forth above is achieved, according to this invention, by disposable trunks-type pants having a waist-opening and a pair of leg-openings defined by upper and lower edges, respectively, of the pants.

The disposable trunks-type pants of this invention comprise a pair of intermediate body sheets positioned in plane symmetry to each other and respectively contoured by upper, lower, inner and outer edges, and a pair of lateral body sheets also positioned in plane symmetry to each other outside the respective intermediate body sheets and respectively contoured also by upper, lower, inner and outer edges; and each of the intermediate body sheets is formed between the inner and outer edges with an arcuate cutout convexly extending from the upper edge toward the lower edge, and the intermediate body sheets being put flat and sealed together along a sealing line defined by the cutouts but leaving a narrow marginal edge free, followed by putting the intermediate body sheets and the lateral body sheets flat and sealed together along sealing lines defined by the inner and outer edges of these body sheets but leaving narrow marginal regions free outside the inner and outer edges.

According to one embodiment of this invention, the intermediate body sheet is formed with the cutout in a manner that an angle at which opposite ends of the cutout intersect the upper edge of the intermediate body sheet is 30°–90°, a dimension from the inner edge to the adjacent one of the opposite ends of the cutout is larger than a dimension from the outer edge to the adjacent one of the opposite ends of the cutout and a total of these two dimensions is 5%–30% of a transverse dimension of the intermediate body sheet as measured along the upper edge thereof.

According to another embodiment of this invention, a bottom of the cutout is offset toward the inner edge of the intermediate body sheet.

According to still another embodiment of this invention, a first elastic member circumferentially extending along a periphery of the waist-opening is bonded with a tension to inner and/or outer surfaces of the lateral body sheets.

According to another further embodiment of this invention, second elastic members circumferentially extending along peripheries of the leg-openings are bonded under tension to the intermediate body sheets and/or the lateral body sheets.

According to an additional embodiment of this invention, the intermediate body sheets and/or said lateral body sheets are made of a nonwoven fabric.

DESCRIPTION OF THE BEST MODE FOR CARRY OUT THE INVENTION

Details of disposable trunks-type pants according to this invention will be more fully understood from the description given hereunder with reference to the accompanying drawings.

Figure 1:
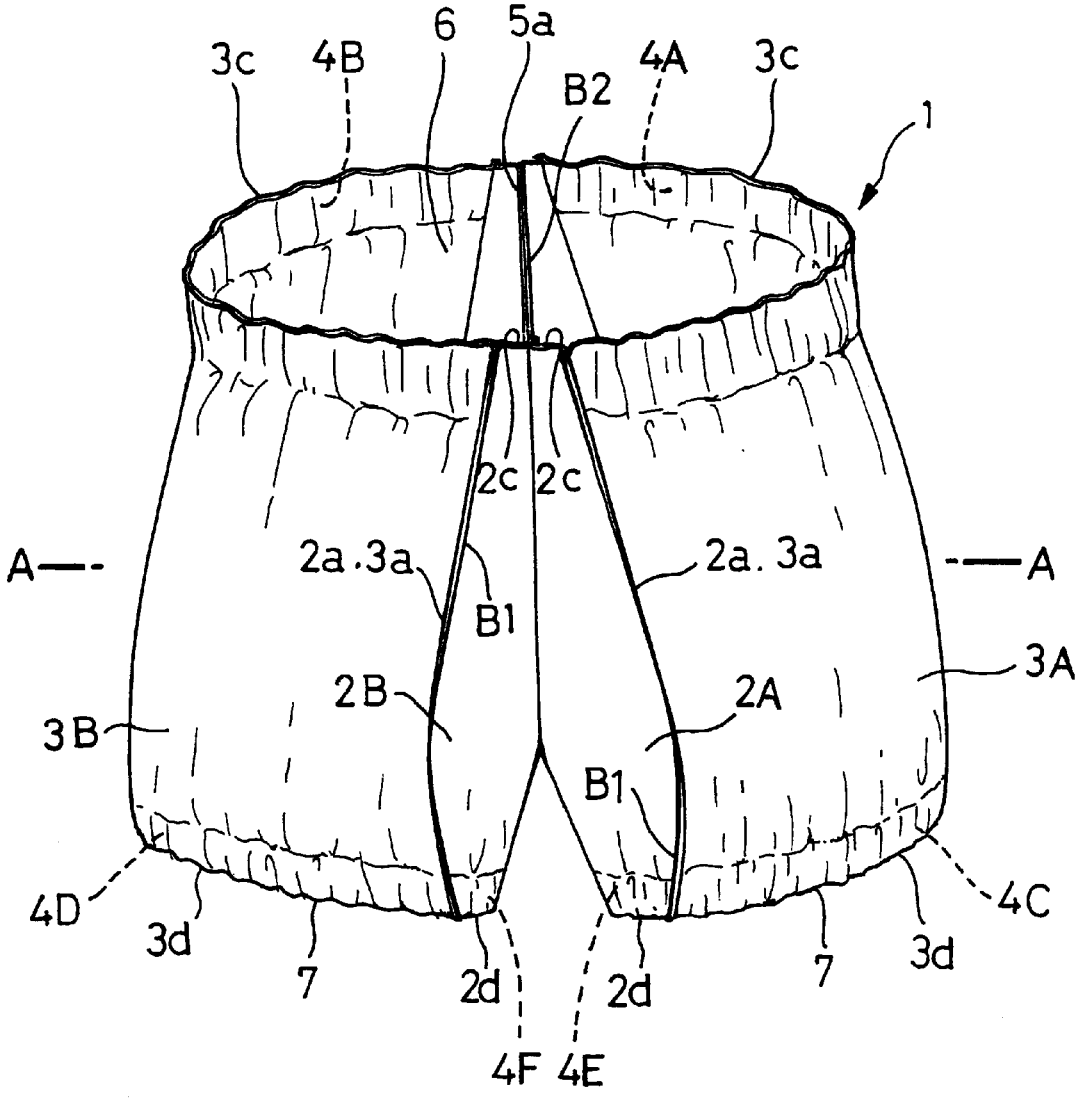
FIG. 1 is a perspective view of trunks-type pants according to this invention.
Figure 2:
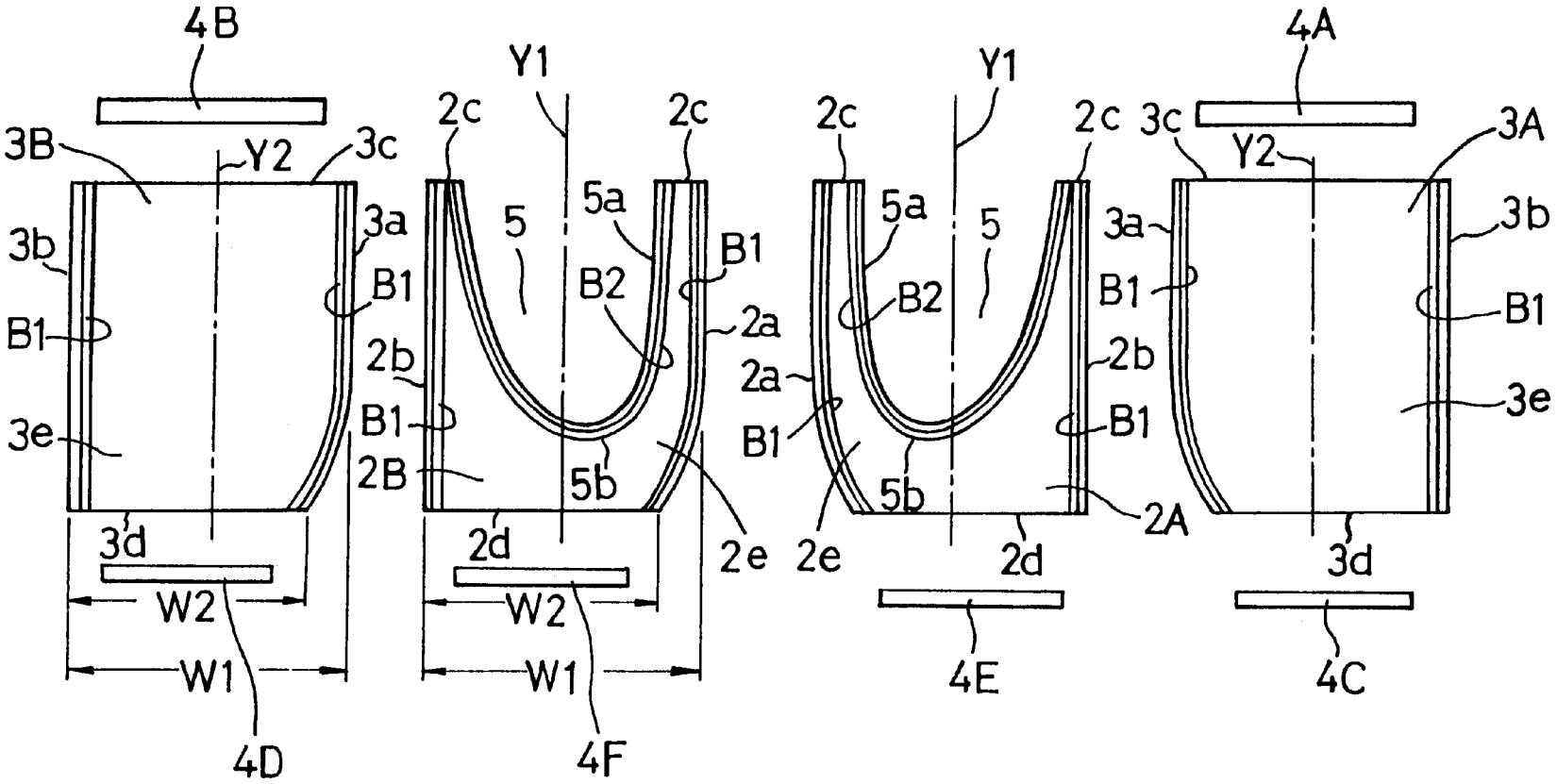
FIG. 2 is an exploded plan view of the pants shown in FIG. 1.

FIG. 1 is a perspective view of disposable trunks-type pants 1 and FIG. 2 is an exploded plan view of the same pants 1 comprising a pair of intermediate body sheets 2A, 2B and a pair of lateral body sheets 3A, 3B, with each of these pairs being illustrated as positioned in plane-symmetry to each other. The pants 1 have a waist-opening 6 defined by upper edges of these sheets 2A, 2B, 3A, 3B to surround a wearer's trunk and a pair of leg-openings 7 defined by lower edges of these sheets to surround the wearer's legs as the sheets 2A, 2B, 3A, 3B are sealed together in a predetermined manner. The upper edges of the lateral body sheets 3A, 3b which together define a peripheral edge the waist-opening 6 are respectively provided with first elastic members 4A, 4B bonded under tension thereto. The lower edges of the lateral body sheets 3A, 3B and the intermediate body sheets 2A, 2B which together define peripheral edges of the pair of leg-openings 7 are also respectively provided with second elastic members 4C, 4D, 4E, 4F bonded under tension thereto. It is possible without departing from the spirit or the scope of this invention to provide the elastic members only along the peripheral edge of the waist-opening 6.

As will be apparent from FIG. 2, the pants 1 comprise the pair of intermediate body sheets 2A, 2B positioned in plane symmetry to each other and the pair of lateral body sheets 3A, 3B lying outside the respective intermediate body sheets 2A, 2B also in plane symmetry to each other. Referring to FIG. 2, the pair of intermediate body sheets 2A, 2B are the reflected images relative to each other and the pair of lateral body sheets 3A, 3B are also the reflected images relative to each other. Accordingly, inner and outer side edges 2*a*, 2*b*; 3*a*, 3*b* of the intermediate body sheet 2A and the body sheet 3A are reversely positioned relative to those of the other intermediate body sheet 2B and lateral body sheet 3B.

The intermediate body sheet 2A, 2B has upper and lower edges 2*c*, 2*d* extending in parallel to each other in the transverse direction and the inner and outer side edges 2*a*, 2*b* extending in the longitudinal direction which intersects the transverse direction at right angles. Between the inner and outer side edges 2*a*, 2*b*, the intermediate body sheet 2A, 2B is formed with an arcuate cutout 5 convexly extending from the upper edge 2*c* toward the lower edge 2*d*. The cutouts 5 of the respective intermediate body sheets 2A, 2B are positioned in plane symmetry to each other.

The inner side edge 2*a* of the intermediate body sheet 2A, 2B extends from the upper edge 2*c* toward the lower edge 2*d* so as to describe an arc progressively deflecting toward a center line Y1 extending in the longitudinal direction to bisect a transverse dimension of the upper edge 2*c*. The outer side edge 2*b* of the intermediate body sheet 2A, 2B extends in parallel to the center line Y1. The upper edge 2*c* of the intermediate body sheet 2A, 2B has a transverse dimension W1 larger than a transverse dimension W2 of the lower edge 2*d* of the intermediate body sheet 2A, 2B.

The intermediate body sheet 2A, 2B is provided along its inner and outer side edges 2*a*, 2*b* with a pair of first sealing lines B1, B1, leaving narrow marginal regions of the respective side edges 2*a*, 2*b* free, which extend outside these first sealing lines B1, B1. In addition to these first sealing lines B1, B1, the intermediate body sheet 2A, 2B is provided along the cutout 5 with a second sealing line B2, leaving a narrow marginal edge 5*a* of the cutout 5 free. The intermediate body sheets 2A, 2B are further provided on their inner surfaces 2*e*, 2*e* with second elastic members 4E, 4F bonded under tension thereto and extending in the transverse direction along the respective lower edges 2*d*.

Each of the lateral body sheets 3A, 3B has upper and lower edges 3*c*, 3*d* extending in parallel to each other in the transverse direction and inner and outer edges 3*a*, 3*b* extending in the longitudinal direction which intersects the transverse direction at right angles. The upper and lower edges 3*c*, 3*d* as well as the inner and outer side edges 3*a*, 3*b* of the lateral body sheets 3A, 3B have same transverse dimensions as those of the intermediate body sheets 2A, 2B.

The lateral body sheets 3A, 3B have their inner side edges 3*a*, 3*a* each extending from the upper edge 3*c* toward the lower edge 3*d* so as to describe an arc progressively deflecting toward a second center line Y2 which, in turn, extends in the longitudinal direction to bisect a transverse dimension of the upper edge 3*c*. The lateral body sheets 3A, 3B have their outer edges 3*b*, 3*b* extending in parallel to the second center line Y2. In the lateral body sheets 3A, 3B, the transverse dimension W1 of the upper edge 3*c* is larger than the transverse dimension W2 of the lower edge 3*d*.

Each of the lateral body sheets 3A, 3B is provided with first sealing lines B1, B1 extending along its inner and outer edges 3*a*, 3*b*, leaving narrow marginal regions of these edges 3*a*, 3*b* free. The lateral body sheets 3A, 3B are provided with first and second elastic members 4A, 4B, 4C, 4D bonded under tension to their inner surfaces and extending in the transverse direction along their upper and lower edges 3*d*, 3*c*.

Figure 3:
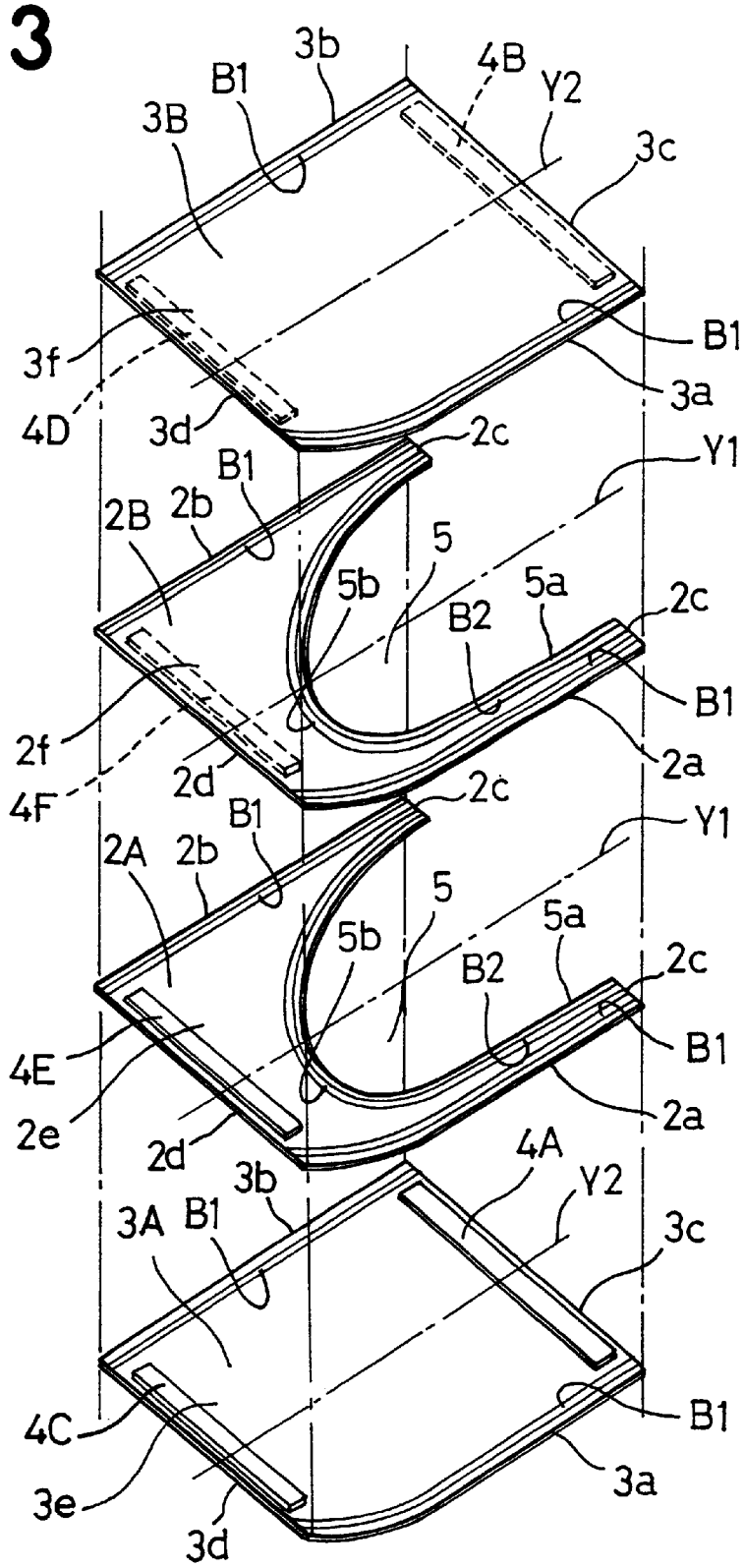
FIG. 3 is an exploded perspective view of the pants shown in FIG. 1.

FIG. 3 is an exploded perspective view of the pants 1 with the pairs of sheets 2A, 2B; 3A, 3B being symmetrically arranged, respectively. The pair of intermediate body sheets 2A, 2B are placed one upon another with their center lines Y1 being exactly in mutual alignment and the inner surfaces 2*e*, 2*e* of these sheets 2A, 2*b* are sealed together continuously or intermittently along the second sealing lines B2, B2. At this time point, the intermediate body sheets 2A, 2B have their inner and outer edges 2*a*, 2*b*, upper and lower edges 2*c*, 2*d* and the edges 5*a* of the cutouts 5 exactly aligned one with another.

One of the intermediate body sheets 2A and one of the lateral body sheets 3A are placed one upon another with their center lines Y1, Y2 being exactly aligned with each other and then the outer surface 2*f* of this intermediate body sheet 2A and the inner surface 3*e* of the this lateral body sheet 3A are sealed with each other continuously or intermittently along the pair of first sealing lines B1, B1 with the first and second elastic members 4A, 4C, 4E being maintained under the given tension. Similarly, the other intermediate body sheet 2B and the other lateral body sheet 3B are placed one upon another with their center lines Y1, Y2 being exactly aligned with each other and then the outer surface 2*f* of this intermediate body sheet 2B and the inner surface 3*e* of this lateral body sheet 3B are sealed with each other continuously or intermittently along the pair of first sealing lines B1, B1 with the first and second elastic members 4B, 4D, 4F being maintained under the given tension. At this time point, the inner and outer edges 2*a*, 2*b*; 3*a*, 3*b* as well as the upper and lower edges 2*c*, 2*d*; 3*c*, 3*d* of the intermediate body sheets 2A, 2B and the lateral body sheets 3A, 3B are exactly aligned one with another.

Figure 4:
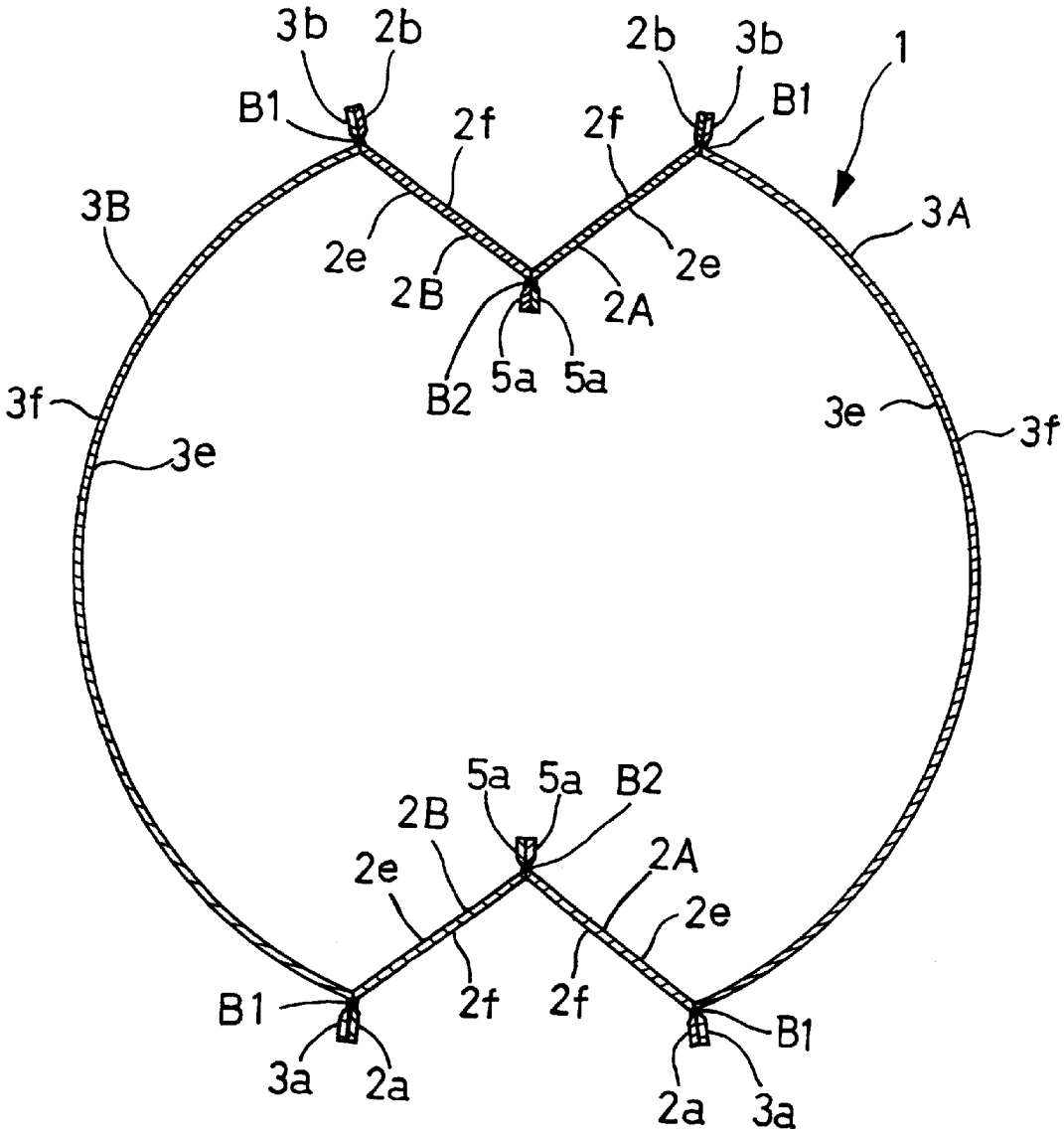
FIG. 4 is a sectional view of the pants shown 1 taken along a line A—A in FIG. 1.

FIG. 4 is a sectional view taken along a A—A in FIG. 1. As will be seen in FIG. 4, the pair of first and second intermediate body sheets 2A, 2B are sealed with each other and are placed one upon another so that the edges 5*a* of the respective cutouts 5 extend inwardly of the pants 1. One of the intermediate body sheets 2A and one of the lateral body sheets 3A are placed one upon another so that the inner and outer edges 2*a*, 2*b*; 3*a*, 3*b* of these sheets 2B, 3B extend outwardly of the pants 1. According to this invention, regions of the pants 1 defined in the vicinity of the cutouts 5 are not folded back outwardly of the pants 1 to seal them together and regions of the pants 1 defined in the vicinity of the inner and outer edges 2*a*, 2*b*, 3*a*, 3*b* are also not folded back inwardly of the pants 1 to seal them together. Such arrangement eliminates concerns that the pants 1 might become bulky particularly in the vicinity of said cutout 5 as well as in the vicinity of the inner and outer edges 2*a*, 2*b*, 3*a*, 3*b* of these sheets 2A, 2B, 3A, 3B. The intermediate body sheets 2A, 2B have none of the elastic members along their upper edges 2*c*, 2*c* and the thickness of these upper edges are correspondingly reduced. The feature as has been described immediately above facilitates the pants 1 to be folded flat.

Both belly and back of the wearer are protected from direct contact with the inner and outer side edges 2*a*, 2*b*, 3*a*, 3*b* of the sheets 2A, 2B, 3A, 3B so that these regions do not adversely affect a feeling to wear the pants 1. Furthermore, the cutouts 5 of the sheets 2A, 2B are sealed with each other leaving the narrow marginal regions thereof free so that a rigidity of the sealed regions is alleviated to maintain a desired soft touch even when the marginal regions of the cutouts 5 come in contact with the wearer's crotch region.

Figure 5:
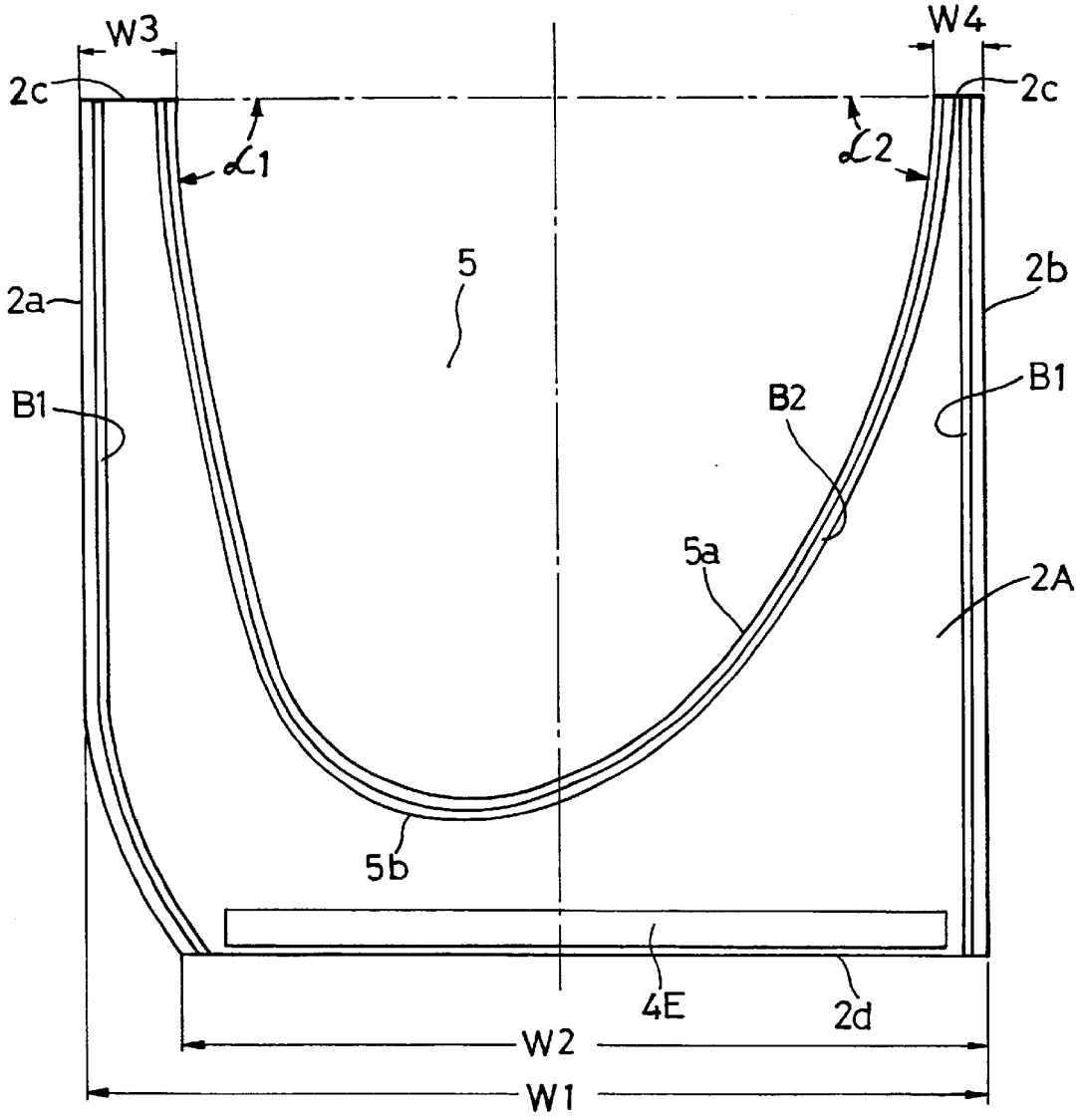
FIG. 5 is a plan view showing one of intermediate body sheets.

FIG. 5 is a plan view of the intermediate body sheet 2A. Angles $\alpha$1, $\alpha$2 at which the edge 5*a* of the cutout 5 intersects the upper edge 2*c* are preferably 30°–90°. A dimension W3 from the inner edge 2*a* to the edge 5*a* of the cutout 5 is larger than a dimension W4 from the outer edge 2*b* to the edge 5*a* of the cutout 5 as measured along the upper edge 2*c* of the intermediate body sheet 2A. These dimensions W3, W4 are preferably 5%–30% of a transverse dimension W1 of said upper edge 2*c*. The dimensions W3, W4 are preferably as small as possible, since a dimension by which the first elastic members 4A, 4B bonded to the lateral body sheets 3A, 3B, respectively, are spaced from each other on the confine of the wearer's belly and back can be minimized. In this way, a contractile force of the first elastic members 4A, 4B are distributed substantially around the wearer's trunk and improve an effect to hold the pants 1 on the wearer's body.

The edge 5*a* of the cutout 5 has its bottom 5*b* offset from the center line Y1 toward the inner edge 2*a* and preferably lies at a distance from said center line Y1 approximately ⅓ of the dimension between the Y1 and the inner edge 21. Such an arrangement enables the cutout 5 of the pants 1 to follow a contour curve of the average wearer's hip and belly.

The intermediate body sheets 2A, 2B and/or the lateral body sheets 3A, 3B are preferably formed by using a stock material such as a spun bond nonwoven fabric or a melt blown nonwoven fabric made of thermoplastic fibers. As the stock material for these sheets, a nonwoven fabric made porous to improve its moisture-permeability or a nonwoven fabric embossed to improve its cushioning property or its elasticity may be also used. Taking account of a fact that a intermediate body sheets are destined to be placed against the wearer's crotch region, the stock material having high liquid-absorptivity, moisture-permeability and soft touch, for example, a nonwoven fabric containing rayon or cotton fibers or a nonwoven fabric resistant against fluffing due to friction is preferably used.

It is possible to adjust a rigidity of the lateral body sheets 3A, 3B to be higher than the rigidity of the intermediate body sheets 2A, 2B for the purpose of stabilizing a shape of the pants 1. For example, spun bond nonwoven fabric having a basis weight of 40 $g/m^2$ or higher may be used as the stock material for the lateral body sheets 3A, 3B.

It is also possible to use a nonwoven fabric having elasticity only in the transverse direction or in the transverse direction and/or in the longitudinal direction as the stock material of the intermediate body sheet 2A, 2B and/or the lateral body sheets 3A, 3*b*. In this case, the first and second elastic members 4A, 4B, 4C, 4D, 4E, 4F may be eliminated.

It is possible without departing from the scope of this invention to bond the first and second elastic members 4A, 4B, 4C, 4D, 4E, 4F to the respective outer surfaces 3*f* of the intermediate body sheets 2A, 2B as well as of the lateral body sheets 3A, 3B. It is also possible to bond these elastic members not only to the inner surfaces 3*e* but also to the outer surfaces 3*f* of these sheets 2A, 2B, 3A, 3B. The first and second elastic members 4A, 4B, 4C, 4D, 4E, 4F may be formed using material selected from a group including synthetic rubber, natural rubber, elastic film containing synthetic rubber, a spun bond nonwoven fabric or a melt blown nonwoven fabric both containing synthetic rubber as its main ingredient, and composite material such as a laminate of nonwoven fabric and suitable elastic material applied thereon under tension. In addition, the first and second elastic members 4A, 4B, 4C, 4D, 4E, 4F bonded to the intermediate body sheets 2A, 2B and the lateral body sheets 3A, 3B may be covered with a nonwoven fabric, if desired.

Though not illustrated, the pants may be provided additionally with an absorbent article comprising a liquid-absorbent core disposed between a liquid-pervious topsheet and a liquid-impervious backsheet. Such an absorbent article will be provided with a fastening sheet, for example, a sheet of urethane foam having a reasonably high friction factor or an adhesive sheet by means of which the absorbent article may be fastened to a retaining belt having its longitudinally opposite ends connected to the pants at front and rear sides of the latter.

The lateral body sheets 3A, 3B as well as the intermediate body sheets 2A, 2B can be alternatively configured without departing from the spirit or the scope of the invention. For example, both the inner edges 2*a*, 3*a* and the outer edges 2*b*, 3*b* of these sheets 3A, 3B, 2A, 2B may curvedly or rectilinearly extend so that, in both cases, the inner and outer edges progressively deflect toward the respective center lines Y1, Y2 as they extend downward from the respective upper edges 2*c*, 3*c* to the respective lower edges 2*d*, 3*d*.

Operation of bonding these sheets one to another can be carried out using suitable adhesive agent such as hot melt adhesive or a sealing technique such as heat- or ultrasonic-sealing.

With the trunks-type pants of this invention, most of the sealing lines extend from the upper edge to the lower edge of the pants substantially in the vertical direction. Rigidity of these sealing lines advantageously alleviate a possible tendency that the cuffs of the pants might be turned up inside out during actual use of the pants. Particularly when nonwoven fabric is used as the stock material for the intermediate body sheets as well as for the lateral body sheets, the pants of this invention can be made more easily and more inexpensively than when the corresponding sheets of cloth are stitched together to make the pants. The pants of this invention adapted to be inexpensively mass-produced merely by sealing the component sheets together satisfactorily meet the requirements for the disposable garment in general.

What is claimed is:

1. Disposable trunks-type pants having upper and lower portions, said disposable trunks-type pants comprising:

a waist-opening at the upper portion;

a pair of leg-openings at the lower portion;

a pair of intermediate body sheets positioned in coplanar and coextensive alignment with one another and being respectively contoured by upper, lower, inner and outer edges:

a pair of lateral body sheets also positioned in coplanar and coextensive alignment with one another and with the pair of intermediate body sheets and being positioned outside the intermediate body sheets and being respectively contoured by upper, lower, inner and outer edges, each of said intermediate body sheets being formed between said inner and outer edges with an arcuate cutout convexly extending from said upper edge toward said lower edge, said intermediate body sheets being put flat and sealed together along a sealing line defined adjacent said cutouts, which sealing line leaves a narrow marginal edge free, said intermediate body sheets and said lateral body sheets being put flat and sealed together along sealing lines defined by said inner and outer edges thereof which sealing lines leave narrow marginal regions free outside said inner and outer edges.

2. Disposable trunks-type pants according to claim 1 wherein:

said cutouts have opposite ends that intersect upper edges of said intermediate body sheets at an angle of 30°–90°, a dimension measured from said inner edge to an adjacent one of said opposite ends of each of said cutouts is larger than a dimension measured from said outer edge to an adjacent one of said opposite ends of each of said cutouts, and a total of these two dimensions is 5%–30% of a transverse dimension of each of said intermediate body sheets as measured along said upper edge thereof.

3. Disposable trunks-type pants according to claim 1, wherein in each of the intermediate body sheets a bottom of said cutout is offset toward said inner edge thereof.

4. Disposable trunks-type pants according to claim 1, further comprising a first elastic member circumferentially extending along a periphery of said waist-opening which is bonded under tension to at least one of inner and outer surfaces of said lateral body sheets.

5. Disposable trunks-type pants according to claim 1, further comprising second elastic members circumferentially extending along peripheries of said leg-openings which are bonded under tension to at least one of said intermediate body sheets and said lateral body sheets.

6. Disposable trunks-type pants according to claim 1, wherein at least one of said intermediate body sheets and said lateral body sheets is made of a nonwoven fabric.

* * * * *